US010650679B2

(12) United States Patent
Xie

(10) Patent No.: US 10,650,679 B2
(45) Date of Patent: May 12, 2020

(54) PARKING NAVIGATION METHOD, DEVICE AND SYSTEM

(71) Applicants: BOE Technology Group Co., Ltd., Beijing (CN); BOE Optical Science and Technology Co., Ltd., Suzhou (CN)

(72) Inventor: Wei Xie, Beijing (CN)

(73) Assignees: BOE TECHNOLOGY GROUP CO., LTD., Beijing (CN); BOE OPTICAL SCIENCE AND TECHNOLOGY CO., LTD., Suzhou (CN)

( * ) Notice: Subject to any disclaimer, the term of this patent is extended or adjusted under 35 U.S.C. 154(b) by 0 days.

(21) Appl. No.: 16/109,330

(22) Filed: Aug. 22, 2018

(65) Prior Publication Data

US 2019/0221122 A1 Jul. 18, 2019

(30) Foreign Application Priority Data

Jan. 15, 2018 (CN) ..... 2018 1 0034933

(51) Int. Cl.
*G08G 1/14* (2006.01)

(52) U.S. Cl.
CPC ..... *G08G 1/142* (2013.01); *G08G 1/146* (2013.01)

(58) Field of Classification Search
CPC ..... G08G 1/142; G08G 1/145; G08G 1/146; G08G 1/147
See application file for complete search history.

(56) References Cited

U.S. PATENT DOCUMENTS

2016/0379495 A1* 12/2016 Engelen ..... G08G 1/005 340/932.2

FOREIGN PATENT DOCUMENTS

| | | | |
|---|---|---|---|
| CN | 203288095 | U | 11/2013 |
| CN | 204315107 | U | 5/2015 |
| CN | 105070064 | A | 11/2015 |
| CN | 105303871 | A | 2/2016 |
| CN | 105761542 | A | 7/2016 |
| CN | 106601023 | A | 4/2017 |
| CN | 107134166 | A | 9/2017 |
| CN | 107230377 | A | 10/2017 |
| CN | 107545777 | A | 1/2018 |

OTHER PUBLICATIONS

First Office Action, including Search Report, for Chinese Patent Application No. 201810034933.0, dated Sep. 11, 2019, 21 pages.

* cited by examiner

*Primary Examiner* — Curtis B Odom
(74) *Attorney, Agent, or Firm* — Westman, Champlin & Koehler, P.A.

(57) ABSTRACT

A parking navigation method, device and system are provided. The parking navigation method comprises: acquiring initial location information of a vehicle; acquiring a target planned path based on a preset rule according to the initial location information and target parking location information; and sequentially turning on lighting devices on the target planned path, to guide the vehicle to travel to a target parking location.

14 Claims, 5 Drawing Sheets

PARKING NAVIGATION METHOD, DEVICE AND SYSTEM

CROSS REFERENCE

This disclosure claims the benefit of Chinese patent application No. 201810034933.0, entitled "Parking Navigation Method, Device and System," filed on Jan. 15, 2018, which is hereby incorporated herein by reference.

TECHNICAL FIELD

The present disclosure relates to the field of navigation, and in particular to a parking navigation method, device, and system.

BACKGROUND

With the continuous improvement of people's living standards, there are more and more family cars. When people go shopping, they usually drive by themselves, which makes it difficult to find a parking location in the parking lot of a mall.

Nowadays, when users go to the parking lot to park, they generally do not know available locations in the parking lot. Only under the guidance of a security guard, they can find available parking locations in a certain area.

SUMMARY

A parking navigation method is disclosed, including:

acquiring initial location information of a vehicle;

acquiring a target planned path based on a preset rule according to the initial location information and target parking location information;

sequentially turning on lighting devices on the target planned path to guide the vehicle to travel to the target parking location.

According to an embodiment of the present disclosure, the step of acquiring a target planned path based on a preset rule according to the initial location information and target parking location information comprises:

acquiring information about at least one target parking location in an available state in a target area;

acquiring at least one planned path according to the initial location information and the information about at least one target parking location; and selecting, according to a preset rule, one planned path from the at least one planned path as the target planned path.

According to an embodiment of the present disclosure, the preset rule includes that information on length of the selected planned path satisfies a first preset condition and/or information on vehicles on the selected planned path satisfies a second preset condition.

According to an embodiment of the present disclosure, the step of sequentially turning on the lighting devices on the target planned path comprises:

transmitting instruction and control information to a first lighting device closest to the vehicle on the target planned path to turn on the first lighting device.

According to an embodiment of the present disclosure, the step of sequentially turning on the lighting devices on the target planned path further comprises:

in response to receiving prompt information from the first lighting device, transmitting, to a second lighting device on the target planned path closest to the first lighting device in a direction of travel of the vehicle, the instruction and control information to turn on the second lighting device.

According to an embodiment of the present disclosure, the step of transmitting to the second lighting device the instruction and control information in response to receiving prompt information from the first lighting device comprises, before transmitting to the second lighting device the instruction and control information:

determining whether there is a lighting device within a preset area of the second lighting device;

if there is a lighting device within the preset area of the second lighting device, determining whether the lighting device within the preset area is in a turned-on state or not; and turning on the second lighting device if the lighting device within the preset area is in a turned-off state.

According to an embodiment of the present disclosure, if the lighting device within the preset area is in a turned-on state, the step of transmitting to the second lighting device the instruction and control information in response to receiving prompt information from the first lighting device further comprises, before transmitting to the second lighting device the instruction and control information:

waiting for the lighting device within the preset area to change from the turned-on state to the turned-off state.

According to an embodiment of the present disclosure, after the step of acquiring a target planned path based on the preset rule, the method further comprises:

modifying identification information of the target parking location to identification information of being occupied, wherein the identification information of being occupied is used to indicate that the target parking location is in an unavailable state.

According to an embodiment of the present disclosure, the method further comprises modifying the identification information of the target parking location to identification information of being available when it is detected that the vehicle is moving away from the target area.

Alternatively, the number of the lighting devices is two or more, and the on-duration of each of the lighting devices is 5 to 10 seconds.

The disclosure also discloses a parking navigation device, comprising:

a memory in which computer program codes are stored;

a processor configured to execute the computer program codes stored in the memory to:

acquire initial location information of a vehicle;

acquire a target planned path based on a preset rule according to the initial location information and target parking location information;

transmit instruction and control information to lighting devices on the target planed path so as to sequentially turn on the lighting devices on the target planned path to guide the vehicle to travel to the target parking location.

According to an embodiment of the present disclosure, the processor is further configured to execute the computer program codes to:

acquire information about at least one target parking location in an available state in a target area;

acquire at least one planned path according to the initial location information and the information about at least one target parking location; and select, according to a preset rule, one planned path from the at least one planned path as the target planned path.

According to an embodiment of the present disclosure, the preset rule includes that information on length of the selected planned path satisfies a first preset condition and/or information on vehicles on the selected planned path satisfies a second preset condition.

According to an embodiment of the present disclosure, the processor is further configured to execute the computer program codes to:

transmit the instruction and control information to a first lighting device closest to the vehicle on the target planned path to turn on the first lighting device.

According to an embodiment of the present disclosure, the processor is further configured to execute the computer program codes to:

in response to receiving prompt information from the first lighting device, transmit, to a second lighting device on the target planned path closest to the first lighting device in a direction of travel of the vehicle, the instruction and control information to turn on the second lighting device.

According to an embodiment of the present disclosure, the processor is further configured to execute the computer program codes to, before transmitting the instruction and control information to the second lighting device:

determine whether there is a lighting device within a preset area of the second lighting device;

if there is a lighting device within the preset area, determine whether the lighting device within the preset area is in a turned-on state or not; and turn on the second lighting device if the lighting device within the preset area is in a turned-off state.

According to an embodiment of the present disclosure, if the lighting device within the preset area is in a turned-on state, the processor is further configured to execute the computer program codes to, before transmitting the instruction and control information to the second lighting device:

wait for the lighting device within the preset area to change from the turned-on state to the turned-off state.

According to an embodiment of the present disclosure, the processor is further configured to execute the computer program codes to:

modify identification information of the target parking location to identification information of being occupied, wherein the identification information of being occupied is used to indicate that the target parking location is in an unavailable state; and modify the identification information of the target parking location to identification information of being available when it is detected that the vehicle is moving away from the target area.

Alternatively, the number of the lighting devices is two or more, and the on-duration of each of the lighting devices is 5 to 10 seconds.

The present disclosure further discloses a parking navigation system comprising the parking navigation device of any of the above. The parking navigation system may further comprise a sensor and a lighting device.

The sensor is configured to generate sensing information when a vehicle enters the sensing range of the sensor, and to transmit the sensing information to the lighting device.

The lighting device is configured to be turned on in response to receiving indication and control information, and to transmit prompt information to the parking navigation device when receiving the sensing information from the sensor.

DETAILED DESCRIPTION

In order to make the above described objects, features and advantages of the present disclosure more apparent, the disclosure will be further described in detail in connection with the drawings and the detailed description.

The parking solutions in the related art are generally based on an Internet of Things platform, which accepts the parking demand information sent by a vehicle, then queries relevant information about available locations in a parking lot, and finally recommends information about the parking location of the vehicle. However, such a solution can only tell the user that he/she can park, but cannot quickly guide the user to the position of an available parking location. In addition, if the parking lot is underground, the user may not be able to use a navigation system to find the position of the available parking location. Therefore, the user may take a long time to find the available parking location, which significantly wastes the user's time.

Figure 1:
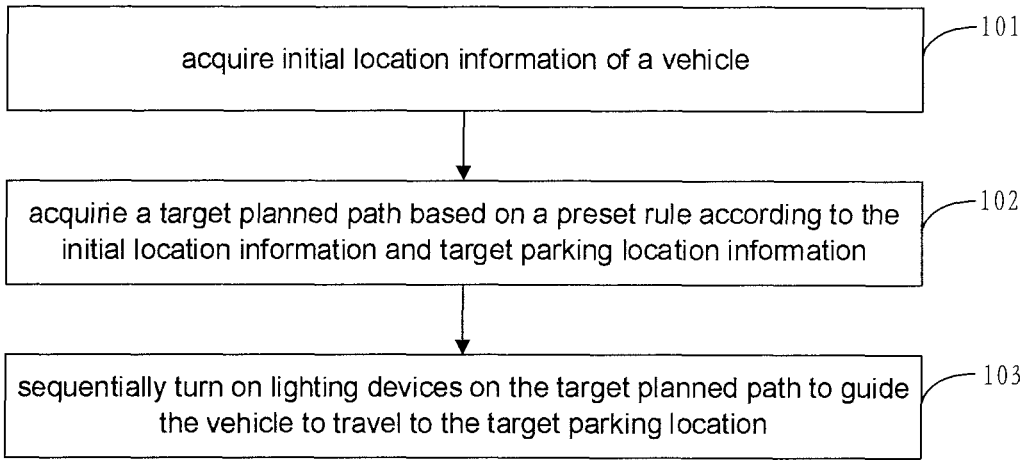
FIG. 1 illustrates a flowchart of steps of a parking navigation method according to an embodiment of the present disclosure.

Referring to FIG. 1, a flowchart of steps of a parking navigation method according to an embodiment of the present disclosure is shown, which may particularly include the following steps:

Step 101: acquiring initial location information of a vehicle.

Embodiments of the present disclosure can be applied in various large parking lots (such as a parking lot in a large supermarket, a shopping mall, etc.) to provide guidances for users to find an available parking location.

In embodiments of the present disclosure, a sensor, such as a microwave sensor, may be disposed at an entrance gate of a respective large parking lot, and the microwave sensor may acquire relevant information (such as the license plate number, the model, etc.) of the vehicle and the current location information of the vehicle (i.e., the initial location information) when the user drives through the gate, and then upload the acquired vehicle related information and the initial location information of the vehicle to a central control system.

When the initial location information of the vehicle is acquired, the process proceeds to step 102.

Step 102: acquiring a target planned path based on a preset rule according to the initial location information and target parking location information.

The target parking location information refers to information of a parking location that is available in a parking lot where the vehicle enters.

When the initial location information of the vehicle is acquired, the central control system may plan a target planned path for the vehicle based on a preset rule and according to the initial location information and the target parking location information of the vehicle, so that the vehicle travels according to the target planned path. The preset rule may be preset by the central control system, for example, may be a rule of selecting an available parking location currently closest to the vehicle, or may be a rule of selecting a path with least vehicle thereon for driving the vehicle from the current location to a certain available parking location, etc.

Particularly, details of how to acquire the target planned path according to a preset rule will be described in the following embodiments, and thus are not further described here in the embodiment of the present disclosure.

After acquiring the target planned path according to the preset rule, the process proceeds to step 103.

Step 103: sequentially turning on lighting devices on the target planned path to guide the vehicle to travel to the target parking location.

In an embodiment of the present disclosure, the lighting devices, such as LED lights, etc., may be disposed on each route of the parking lot at intervals (such as every 5 m or 8 m, etc.). After the target planned path has been designed, the central control system transmits standby control information to each lighting device to control each lighting device on the target planned path to be in a standby state, and thereby the central control system sequentially turns on the lighting devices on the target planned path by transmitting the instruction and control information to each lighting device, so as to guide the vehicle to travel to the target parking location in accordance with the lighting order of the lighting devices.

Particularly, details of how to sequentially turn on the lighting devices on the target planned path will be described in the following embodiments, and thus are not further described here.

Of course, in embodiments of the present disclosure, the number of the lighting devices on the target planned path is at least two, that is, one lighting device may be disposed at an intermediate position between the vehicle and the target parking location, and one lighting device is disposed at the target parking location. Then the user may drive the vehicle to the target parking location by observing the positions of the two sequentially turned-on lighting devices.

Details of how to sequentially turn on the lighting devices on the target planned path will be described in the following embodiments, and thus are not further described here.

In embodiments of the present disclosure, it is also possible to set the on-duration of each lighting device (except for the lighting device at the target parking location) to 5-10 seconds. When the turned-on time of a lighting device reaches the set on-duration (for example, 5 s, 8 s, etc.), the lighting device will be automatically turned off until the vehicle arrived at the target parking location, so that the purpose of power saving can be achieved.

Alternatively, the lighting device at the target parking location may be set to have a longer on-duration, such as 3 minutes, 5 minutes, etc., to provide illumination for the user to park.

Of course, in practical applications, it may be optional to set the on-duration of each lighting device to 5 seconds to achieve the purpose of power saving to a maximum extent.

The parking navigation flow will be generally described below with reference to the drawings.

Figure 2:
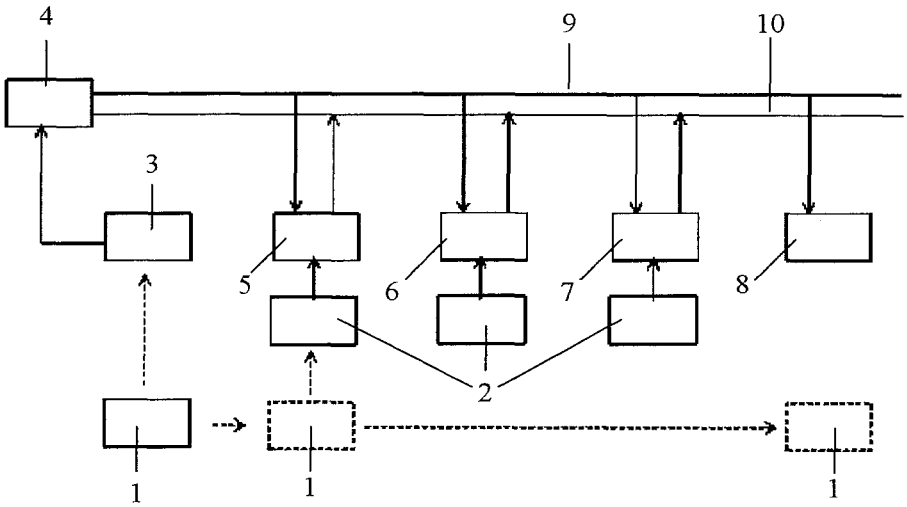
FIG. 2 illustrates a schematic diagram of a parking navigation process according to an embodiment of the present disclosure.

Particularly, referring to FIG. 2, a schematic diagram of a parking navigation process according to an embodiment of the present disclosure is shown. As shown, reference numeral 1 denotes a vehicle, reference numeral 2 denotes a sensor, reference numeral 3 denotes a gate, reference numeral 4 denotes a central control system, and reference numerals 5-8 denote lighting devices, wherein the lighting device 8 is a lighting device at a target parking location, reference numeral 9 denotes a light control line, reference numeral 10 denotes a light feedback line, and the dotted arrow indicates the direction of travel of the vehicle.

When the vehicle 1 arrives at the gate 3 of the target area (such as a parking lot in a large shopping mall, etc.), the gate 3 may acquire relevant information of the vehicle 1 (such as the license plate number, the model, etc.) and current location information of the vehicle and transmit the relevant information of the vehicle 1 and the current location information of the vehicle to the central control system 4. The central control system 4 searches for at least one target parking location in an available state within the target area according to the current location information of the vehicle 1, plans at least one planned path for the vehicle 1 according to the searched at least one parking location and the current location information of the vehicle 1, and acquires an optimal planned path as the target planned path according to a preset rule.

After the target planned path has been designed, the central control system 4 transmits instruction and control information to the lighting device 5 through the light control line 9 to control the lighting device 5 to turns on automatically, and transmits standby control information to the lighting devices 6-8 on the target planned path through the light control line 9 to cause the lighting devices 6-8 to be in a standby state, and the location information of the vehicle 1 is acquired in real time by the sensor 2 provided on each of the lighting devices. When the sensor 2 provided on the lighting device 5 senses that the vehicle 1 has entered the sensing range of the sensor 2, the sensor 2 transmits sensing information to the lighting device 5, and the lighting device 5 generates prompt information and passes the prompt information to the central control system 4 through the light feedback line 10 to prompt that the vehicle 1 enters the sensing range of the sensor 2. Further, the central control system 4 generates instruction and control information based on the prompt information, and transmits the instruction and control information to the lighting device 6 through the light control line 9 to control the lighting device 6 to automatically turn on, and so on. The central control system 4 sequentially turns on the lighting devices 5-8 on the target planned path, and thereby guides the vehicle 1 to the target parking location located at the lighting device 8.

The parking navigation method according to the embodiment of the present disclosure directs a vehicle to travel to a target parking location by acquiring initial location information of the vehicle, acquiring a target planned path based on a preset rule according to the initial location information and target parking location information, and sequentially turning on lighting devices on the target planned path. In the embodiment of the present disclosure, by designing a target planned path for the vehicle entering the parking lot, and thereby turning on lighting devices on the target planned path to guide the vehicle to the target parking location, the user does not need to find available parking locations by himself, which greatly saves the user's time.

Figure 3:
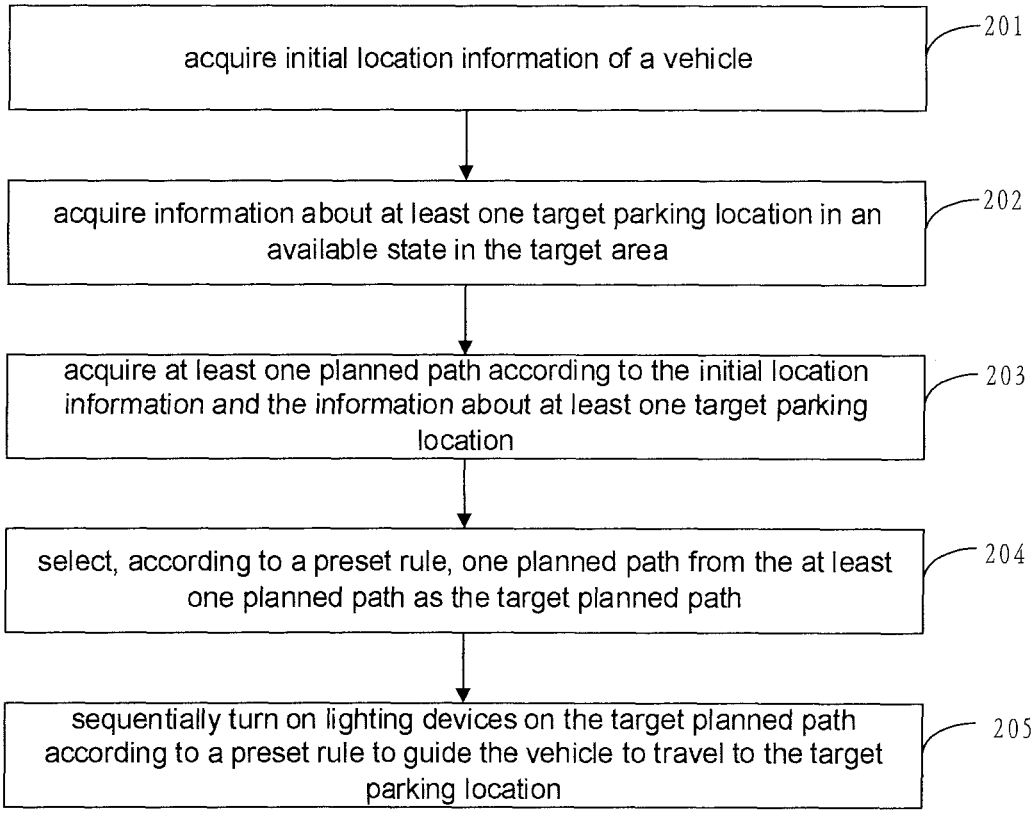
FIG. 3 illustrates a flowchart of steps of a parking navigation method according to an embodiment of the present disclosure.

Referring to FIG. 3, a flowchart of steps of a parking navigation method according to an embodiment of the present disclosure is shown, which may particularly include the following steps:

Step 201: acquiring initial location information of a vehicle.

The implementation of step 201 is similar to that of step 101 in the above embodiment, and thus is not further described here.

After the initial location information of the vehicle is acquired, the process proceeds to step 202.

Step 202: acquiring information about at least one target parking location in an available state in the target area.

In embodiments of the present disclosure, the target area refers to an area covered by a parking lot that the vehicle enters, and the target parking location in an available state refers to a parking location which is not occupied by a vehicle in the target area and will not be occupied by a vehicle coming soon on a planned path.

When the central control system acquires the initial location information of the vehicle, that is, when the central control system detects that the vehicle enters the target area, it acquires the information about target parking locations in an available state in this target area. For example, there are 3 available parking locations currently in the parking lot A, namely parking location 1, parking location 2, and parking location 3. When the vehicle is detected to enter the parking lot A, the central control system has knowledge of the available parking locations 1, 2, 3 in the parking lot A.

Of course, in the above example, when only the parking location 3 in the parking lot A is in an available state, the central control system needs to acquire only the location information of the parking location 3.

After acquiring information about at least one target parking location in an available state in the target area, the process proceeds to step 203.

Step 203: acquiring at least one planned path according to the initial location information and the information about at least one target parking location.

After acquiring the initial location information of the vehicle and the information about at least one target parking location in an available state, at least one planned path is acquired according to the initial location information and the target parking location information, that is, a planned path from the initial location information to the at least one target parking location in an available state.

It can be understood that, when there is only one available parking location in the target area, there may be one or more planned paths of the vehicle from the initial location to that available parking location, which may be particularly determined according to actual conditions. In embodiments of the disclosure, the number of planned paths from the initial location to a certain parking location is not limited to one.

When there is more than one available parking location in the target area, there is a plurality of planned paths to each available parking location accordingly.

After acquiring at least one planned path, the process proceeds to step 204.

Step 204: selecting, according to a preset rule, one planned path from the at least one planned path as the target planned path.

In embodiments of the present disclosure, the preset rule may include that the length of the selected planned path satisfies a first preset condition, that is, one planned path with the shortest length is selected from the at least one planned path obtained in the above step 203 as the target planned path, and the user's parking time is reduced by shortening the parking distance.

The preset rule may also include that the information on vehicles on the selected planned path satisfies a second preset condition, that is, one planned path with the least vehicles thereon is selected from the at least one planned path obtained in the above step 203 as the target planned path, to avoid the effect of traffic on the user's parking time.

Of course, in embodiments of the present disclosure, the preset rule may include the above two rules at the same time, that is, the information on length of the selected planned path satisfies the first preset condition, and the information on vehicles on the selected planned path satisfies the second preset condition.

In a specific implementation, the at least one planned path may be first sorted according to length information in an order of the length from short to long, and then the N (e.g, 2 or 3) planned paths ranked top are selected (they may also be sorted in an order of the length from long to short, and then the planned paths ranked bottom are selected). Then the N planned paths ranked top are sorted according to the information on vehicles on these N planned paths, sorted in an order of the number of vehicles from less to more, and the planned path ranked first is selected as the target planned path (they may also be sorted in an order of the number of vehicles on the planned paths from more to less, and the planned path ranked last is selected as the target planned path).

In practical applications, those skilled in the art may set the preset rule for acquiring the target planned path according to actual needs. For example, the selected planned path has fewer turns to facilitate driving the vehicle to the target parking location. Embodiments of the present disclosure do not limit this.

In an optional embodiment of the present disclosure, after the above step 204, the method may further include:

Step S1: modifying identification information of the target parking location to identification information of being occupied, wherein the identification information of being occupied is used to indicate that the target parking location is in an unavailable state.

When it is detected that the vehicle is moving away from the target area, the method further includes:

Step S2: modifying the identification information of the target parking location to identification information of being available.

In embodiments of the present disclosure, each parking location is provided with corresponding identification information in the central control system. For example, there are parking location 1, parking location 2, and parking location 3 in the parking lot N, and the three parking locations are assigned with signs A, B, and C respectively. The identification information of each parking location may include two types, that is, identification information of being occupied which indicates that the parking location is in an unavailable state and identification information of being available which indicates that the parking location is in an available state.

After the vehicle enters the target area and a target planned path has been designed for the vehicle, the identification information of the corresponding parking location is modified to the identification information of being occupied, indicating that the target parking location is in an unavailable state (before this, the identification information of the parking location is the identification information of being available). When the vehicle leaves the target area, the identification information of the target parking location is modified to the identification information of being available, indicating that the target parking location is in an available state, and the modification of the identification information of the parking location may enable the central control system to timely know the parking locations in an available state or in an unavailable state, so as to plan a path for a vehicle newly entering the target area.

After selecting, according to a preset rule, one planned path from the at least one planned path as the target planned path, the process proceeds to step 205.

Step 205: sequentially turning on lighting devices on the target planned path to guide the vehicle to travel to the target parking location.

After selecting the target planned path, lighting devices on the target planned path are sequentially turned on to guide the vehicle to travel to the target parking location.

The parking navigation method according to the embodiment of the present disclosure can, in addition to having the beneficial effects of the parking navigation method shown in the above embodiment, also select a target planned path for the vehicle according to a preset rule, which facilitates the user to drive and saves the user's time to park.

Figure 4:
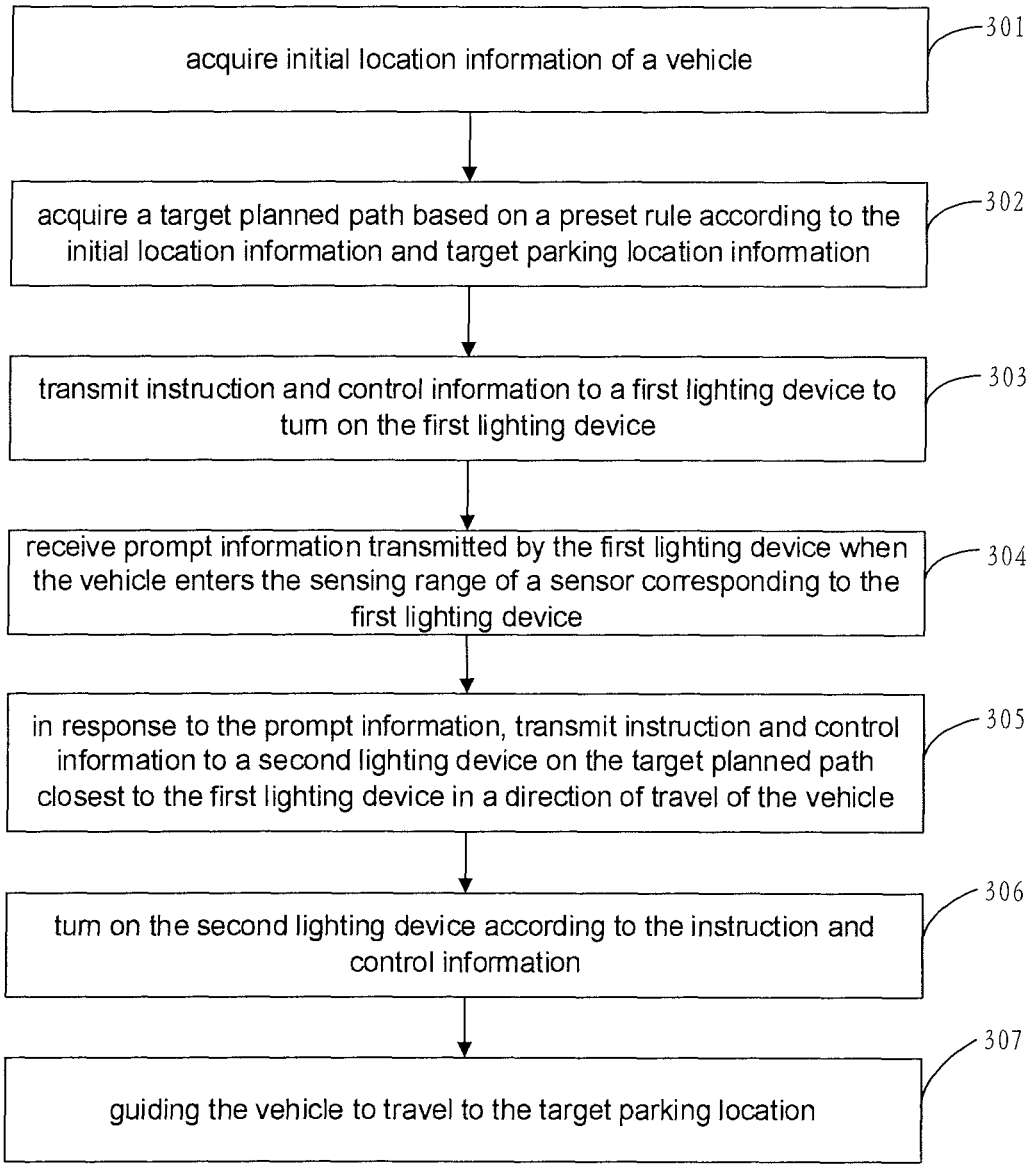
FIG. 4 illustrates a flowchart of steps of a parking navigation method according to an embodiment of the present disclosure.

Referring to FIG. 4, a flowchart of steps of a parking navigation method according to an embodiment of the present disclosure is shown, which may particularly include the following steps:

Step 301: acquiring initial location information of a vehicle.

Step 302: acquiring a target planned path based on a preset rule according to the initial location information and target parking location information.

In an embodiment of the present disclosure, the implementations of steps 301-302 are similar to those of steps 201-204 in the above embodiment, and thus are not further described here.

Step 303: transmitting instruction and control information to a first lighting device to turn on the first lighting device.

In the embodiment of the present disclosure, the first lighting device refers to a lighting device that is closest to the vehicle on the target planned path when the vehicle enters the target area.

After the vehicle enters the target area and a target planned path has been designed for the vehicle, the central control system controls the first lighting device on the target planned path to be turned on to guide the user to drive the vehicle toward the turned-on lighting device.

After the first lighting device is turned on, the process proceeds to step 304.

Step 304: receiving prompt information transmitted by the first lighting device when the vehicle enters the sensing range of a sensor corresponding to the first lighting device which is closest.

In the embodiment of the present disclosure, a corresponding sensor, such as a microwave sensor, is disposed on each of the lighting devices. When the vehicle enters the sensing range of the sensor corresponding to a certain lighting device, the sensor generates sensing information and transmits the sensing information to the corresponding lighting device. The lighting device transmits prompt information to the central control system when it received the sensing information from the sensor, the prompt information is used to indicate that the vehicle enters the sensing range of the sensor corresponding to that lighting device.

During the driving of the vehicle according to the target planned path, when the vehicle enters the sensing range of the sensor corresponding to the first lighting device which is closest, the first lighting device transmits prompt information to the central control system to prompt the central control system that the vehicle enters the sensing range of the sensor corresponding to the first lighting device.

After receiving the prompt information from the first lighting device, the process proceeds to step 305.

Step 305, in response to receiving prompt information from the first lighting device, transmitting instruction and control information to a second lighting device on the target planned path closest to the first lighting device in a direction of travel of the vehicle.

In the embodiment of the present disclosure, the second lighting device refers to the lighting device closest to the first lighting device on the target planned path, i.e. the lighting device next to the first lighting device along the traveling direction of the vehicle on the target planned path.

The central control system generates instruction and control information according to the prompt information transmitted by the first lighting device, and transmits the instruction and control information to the second lighting device, the instruction and control information being the instruction information for turning on the second lighting device.

After the instruction and control information is transmitted by the central control system to the second lighting device, the process proceeds to step 306.

Step 306: turning on the second lighting device according to the instruction and control information.

After receiving the instruction and control information, the second lighting device is turned on according to this instruction and control information. Of course, when the vehicle enters the sensing range of the sensor corresponding to the second lighting device, the second lighting device (which becomes the first lighting device at this time) transmits prompt information to the central control system, and the central control system transmits the instruction and control information to a third lighting device (which becomes the second lighting device at this time) according to the prompt information transmitted by the second lighting device, so as to turn on the third lighting device, and so on. The lighting devices on the target planned path are turned on one by one to guide the vehicle to the target parking location.

In another embodiment of the present disclosure, the above step 305, before transmitting the instruction and control information to the second lighting device, may include:

Sub-step N1: determining whether there is a lighting device within a preset area of the second lighting device.

In embodiments of the present disclosure, the preset area refers to a preset range of the second lighting device in the left front and/or the right front of the vehicle in the direction in which the vehicle travels, such as a range of 3 m or 3.5 m in the front left and/or the right front of the second lighting device in the direction in which the vehicle travels, etc. Before transmitting the instruction and control information to turn on the second lighting device, it is determined whether there are other lighting devices within the preset area of the second lighting device. That is, it is determined whether the current second lighting device is at a "cross" intersection or a "T-shaped" intersection.

Particularly, a detailed description will be made with reference to FIG. 5.

Figure 5:
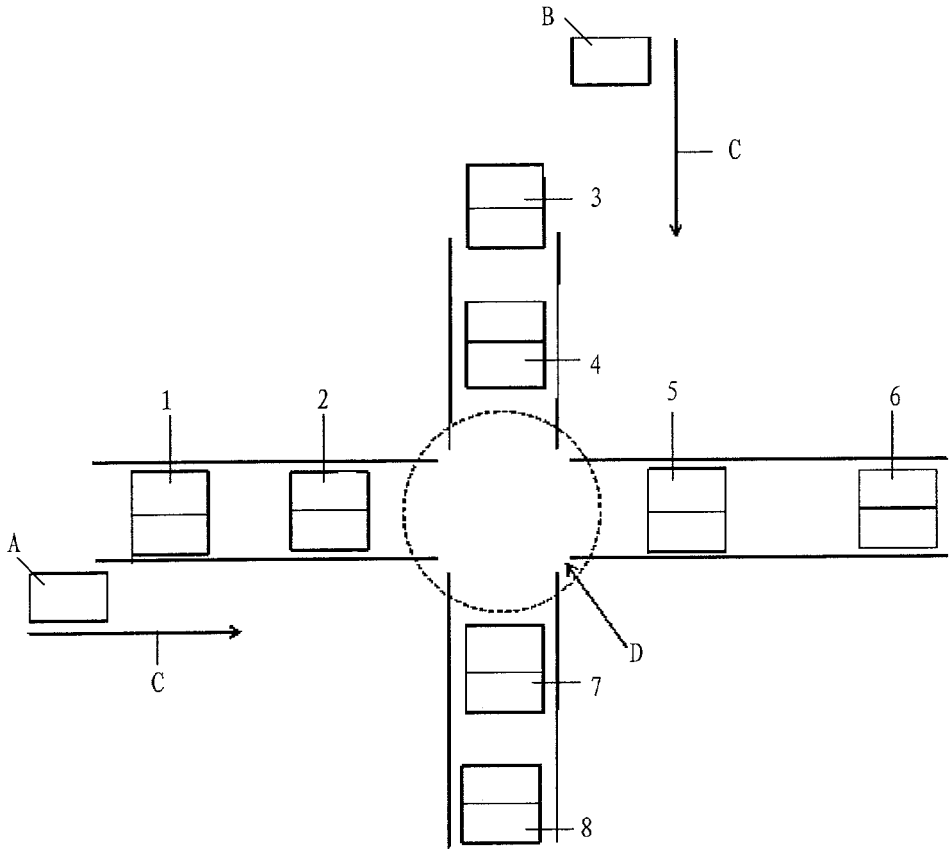
FIG. 5 illustrates a schematic diagram of controlling the turning-on of a lighting device when two cars encounter at a fork in the road according to an embodiment of the present disclosure.

Referring to FIG. 5, a vehicle A and a vehicle B respectively approach the cross intersection D from two directions. When the vehicle A enters the sensing range of the sensor corresponding to the lighting device 1, the lighting device 1 transmits prompt information to the central control system to prompt the central control system that vehicle A enters the sensing range of the sensor corresponding to the lighting device 1. In turn, the central control system determines whether the lighting devices 4 and 7 located in the left front and the right front of the lighting device 2 in the traveling direction of the vehicle A are in a turned-on state. As shown in the figure, there is no vehicle entering the sensing ranges of the sensors corresponding to the lighting devices 8 and 3 at this time, and then the lighting devices 4 and 7 are in a turned-off state, and the central control system controls to transmit the instruction and control information to the lighting device 2 to control the lighting device 2 to be turned on in order to guide the vehicle A to enter the sensing range of the sensor corresponding to the lighting device 2.

When the vehicle A enters the sensing range of the sensor corresponding to the lighting device 2, and the vehicle B enters the sensing range of the sensor corresponding to the lighting device 3, the lighting device 3 transmits prompt information to the central control system to prompt that the vehicle B enters the sensing range of the sensor corresponding to the lighting device 3. In turn, the central control system determines whether the lighting devices 2 and 5 located in the left front and the right front of the lighting device 4 in the traveling direction of the vehicle B are in a turned-on state. At this time, the vehicle A approaches the lighting device 2, and the lighting device 2 is in a turned-on state. When the central control system determines that the lighting device 2 is in a turned-on state, it will not transmit the instruction and control information to the lighting device 4. That is, the lighting device 4 is controlled to be in a standby state to avoid the possible traffic congestion caused by the encounter of the vehicle A and the vehicle B at the cross intersection D, and also avoid the risk of collision of the vehicle A and the vehicle B when they are driven fast.

When there is no lighting device within the preset area of the second lighting device, the second lighting device is directly turned on. Otherwise, the process proceeds to step N2.

Sub-step N2: determining whether the lighting device within the preset area is in a turned-on state or not.

When there are lighting devices within the preset area of the second lighting device, the state of the lighting devices within the preset area is determined. That is, it determines whether the lighting devices within the preset area are in a turned-on state. If the lighting devices within the preset area are in a turned-on state, it indicates that, in the left front and/or right front of the vehicle along the direction of travel of the vehicle, some other vehicles are traveling. At this time, the second lighting device is temporarily suspended to be turned on, in order to allow the other vehicles to travel preferentially to avoid the occurrence of the collision of vehicles or the risk of traffic jams.

When the lighting devices within the preset area are in a turned-off state, the process proceeds to step N3.

Sub-step N3: turning on the second lighting device.

At this time, there is no other vehicle passing through the intersection, and the second lighting device is turned on to provide the vehicle with a parking guidance.

If the lighting devices within the preset area are in a turned-on state, the process proceeds to step N4.

Sub-step N4: waiting for the lighting device within the preset area to change from the turned-on state to the turned-off state.

If the lighting device in the preset area is in a turned-on state, it indicates that, in the left front and/or right front of the vehicle along the direction of travel of the vehicle, some other vehicles are traveling. At this time, the second lighting device is temporarily suspended to be turned on, and waits until the lighting device in the preset area changes from the turned-on state to a turned-off state, that is, the other vehicle has passed, and then the instruction and control information is sent to the second lighting device to continue guiding the vehicle.

Step 307: guiding the vehicle to travel to the target parking location.

The lighting devices on the target planning path are sequentially turned on in the above manner, thereby guiding the vehicle to travel to the target parking position.

The parking navigation method according to embodiments of the present disclosure, in addition to the beneficial effects of the parking navigation method shown in the above embodiment, can also determine whether there is a vehicle passed on both sides of the target planned path when the vehicle is about to arrive at a fork in the road, thereby avoids the occurrence of congestion in the parking lot and the risk of a collision of vehicles.

Figure 6:
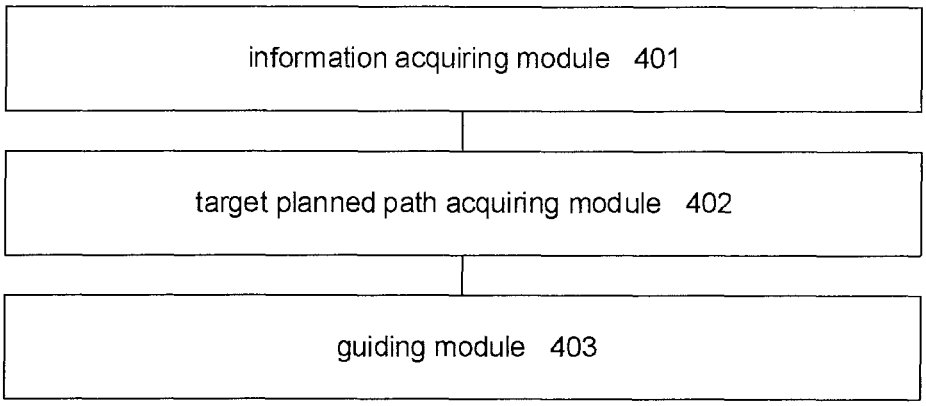
FIG. 6 illustrates a structural illustration diagram of a parking navigation device according to an embodiment of the present disclosure.

Referring to FIG. 6, it illustrates a structural illustration diagram of a parking navigation device according to an embodiment of the present disclosure, which may particularly include:

- an information acquiring module 401 for acquiring initial location information of a vehicle;
- a target planned path acquiring module 402 for acquiring a target planned path based on a preset rule according to the initial location information and target parking location information; and
- a guiding module 403 for sequentially turning on lighting devices on the target planned path to guide the vehicle to travel to the target parking location.

Alternatively, the target planned path acquiring module 402 includes:

- a target parking location acquiring sub-module for acquiring information about at least one target parking location in an available state in the target area;
- a planned path acquiring sub-module for acquiring at least one planned path according to the initial location information and the information about at least one target parking location; and
- a target planned path selecting sub-module for selecting, according to a preset rule, one planned path from the at least one planned path as the target planned path, the preset rule includes that information on length of the selected planned path satisfies a first preset condition and/or information on vehicles on the selected planned path satisfies a second preset condition.

Alternatively, the guiding module 403 includes:

- a first lighting device turning-on sub-module for turning on a first lighting device closest to the vehicle on the target planned path.

The guiding module 403 may further include:

- a prompt information receiving sub-module for receiving prompt information transmitted by the first lighting device when the vehicle enters the sensing range of a sensor corresponding to the first lighting device which is closest;
- an instruction and control information sub-module for transmitting, according to the prompt information, instruction and control information to a second lighting device on the target planned path closest to the first lighting device in a direction of travel of the vehicle; and
- a second lighting device turning-on sub-module for, in response to receiving instruction and control information from the first lighting device, transmitting instruction and control information to a second lighting device on the target planned path closest to the first lighting device in a direction of travel of the vehicle to turn on the second lighting device.

Alternatively, the second lighting device turning-on sub-module includes:

a determining sub-module for determining whether there is a lighting device within a preset area of the second lighting device; and a lighting device determining sub-module for determining whether the lighting device within the preset area is in a turned-on state or not when there is a lighting device within the preset area.

The second lighting device turning-on sub-module is further used for transmitting the instruction and control information to the second lighting device to turn on the second lighting device, if the lighting device within the preset area is in a turned-off state.

Alternatively, the parking navigation device further includes:

a first modifying module for modifying identification information of the target parking location to identification information of being occupied, wherein the identification information of being occupied is used to indicate that the target parking location is in an unavailable state.

Alternatively, the parking navigation device further includes:

a second modifying module for modify the identification information of the target parking location to identification information of being available when it is detected that the vehicle is moving away from the target area.

Alternatively, the number of the lighting devices is two or more, and the on-duration of each of the lighting devices is 5 to 10 seconds.

The parking navigation device according to the embodiment of the present disclosure directs a vehicle to travel to a target parking location by acquiring initial location information of the vehicle, acquiring a target planned path based on a preset rule according to the initial location information and target parking location information, and sequentially turning on lighting devices on the target planned path. In the embodiment of the present disclosure, by designing a target planned path for the vehicle entering the parking lot, and thereby turning on the lighting devices on the target planned path to guide the vehicle to the target parking location, the user does not need to find available parking locations by himself, which greatly saves the user's time.

It can be understood that the location information acquiring module 401, the target planned path acquiring module 402, the guiding module 403 and the prompt information receiving sub-module, the instruction and control information sub-module, the second lighting device turning-on sub-module therein, and the like can be implemented by combining in one module, or any of the modules can be split into multiple modules. Alternatively, at least some of the functionality of one or more of the modules may be combined with at least some of the functionality of other modules and implemented in one module.

According to an embodiment of the present disclosure, at least one of the location information acquiring module 401, the target planned path acquiring module 402, the guiding module 403 and the prompt information receiving sub-module, the instruction and control information sub-module, the second lighting device turning-on sub-module therein, and the like may be partially implemented as a hardware circuit, such as a field programmable gate array (FPGA), a programmable logic array (PLA), a system on chip, a system on a substrate, a system on a package, an application specific integrated circuit (ASIC), or may be implemented in hardware or firmware in any other reasonable manner that integrates or encapsulates the circuit, or may be implemented in a suitable combination of the three implementations of software, hardware, and firmware. Alternatively, at least one of the location information acquiring module 401, the target planned path acquiring module 402, the guiding module 403 and the prompt information receiving sub-module, the instruction and control information sub-module, the second lighting device turning-on sub-module therein, and the like may be at least partially implemented as a computer program module, and when the program is run by a computer, the functions of corresponding module can be executed.

Figure 7:
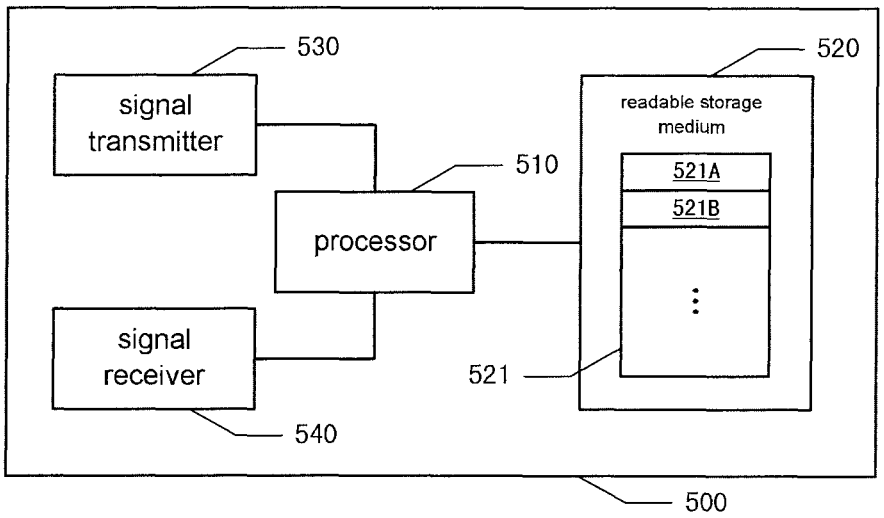
FIG. 7 schematically illustrates a block diagram of a parking navigation device according to another embodiment of the present disclosure.

FIG. 7 schematically illustrates a block diagram of a parking navigation device according to another embodiment of the present disclosure.

As shown in FIG. 7, the parking navigation device 500 includes a processor 510, a computer readable storage medium 520, a signal transmitter 530, and a signal receiver 540. The parking navigation device 500 can perform methods described above with reference to FIGS. 1, 3, and 4 to achieve the guidance of the vehicle.

Particularly, the processor 510 may include, for example, a general-purpose microprocessor, an instruction set processor and/or a related chipset and/or a dedicated microprocessor (e.g., an application specific integrated circuit (ASIC)), and the like. The processor 510 may also include an onboard memory for caching purposes. The processor 510 may be a single processing unit or a plurality of processing units for performing different actions of a method according to embodiments of the present disclosure described with reference to FIGS. 1, 3, and 4.

The computer readable storage medium 520, for example, may be any medium that can contain, store, communicate, propagate or transmit instructions. For example, a readable storage medium may include, but is not limited to, an electronic, magnetic, optical, electromagnetic, infrared, or semiconductor system, apparatus, device, or propagation medium. Specific examples of the readable storage medium include: a magnetic storage device such as a magnetic tape or a hard disk (HDD); an optical storage device such as a compact disk (CD-ROM); a memory such as a random access memory (RAM) or a flash memory; and/or a wired/wireless communication link The computer readable storage medium 520 may contain a computer program 521 that may include code/computer executable instructions that, when executed by the processor 510, cause the processor 510 to perform, for example, methods described above in connection with FIGS. 1, 3, and 4 and any variations thereof.

The computer program 521 may be configured to have computer program codes thereon, which, for example, include a computer program module. For example, in an example embodiment, the codes in the computer program 521 may include one or more program modules, including, for example, module 521A, module 521B, . . . . It should be noted that the division manner and number of modules are not fixed, and those skilled in the art may use suitable program modules or program module combinations according to actual situations. When these program module combinations are executed by the processor 510, it cause the processor 510 to be able to perform, for example, method flows described above in connection with FIGS. 1, 3, and 4 and any variations thereof.

In accordance with an embodiment of the present disclosure, the processor 510 may interact with the signal transmitter 530 and the signal receiver 540 to perform methods described above in connection with FIGS. 1, 3, and 4 and any variations thereof.

According to an embodiment of the present disclosure, at least one of the location information acquiring module 401, the target planned path acquiring module 402, the guiding module 403 and the prompt information receiving sub-module, the instruction and control information sub-module, the second lighting device turning-on sub-module therein, and the like may be implemented as a computer program module described with reference to FIG. 5, and when the computer program module is run by the processor 510, corresponding operations described above can be implemented.

According to an embodiment of the present disclosure, the processor 510 may be configured to execute computer program code to acquire initial location information of a vehicle; acquire a target planned path based on a preset rule according to the initial location information and target parking location information; and transmit instruction and control information to lighting devices on the target planed path so as to sequentially turn on the lighting devices on the target planned path to guide the vehicle to travel to the target parking location.

According to an embodiment of the present disclosure, the processor 510 may be further configured to execute computer program code to acquire information about at least one target parking location in an available state in a target area; acquire at least one planned path according to the initial location information and the information about at least one target parking location; and select, according to a preset rule, one planned path from the at least one planned path as the target planned path.

According to an embodiment of the present disclosure, the processor 510 may be further configured to execute computer program code to transmit instruction and control information to a first lighting device closest to the vehicle on the target planned path to turn on the first lighting device.

According to an embodiment of the present disclosure, the processor 510 may be further configured to execute computer program code to, in response to receiving prompt information from the first lighting device, transmit, to a second lighting device on the target planned path closest to the first lighting device in a direction of travel of the vehicle, the instruction and control information to turn on the second lighting device.

According to an embodiment of the present disclosure, the processor 510 may be further configured to execute computer program code to, before transmitting to the second lighting device the instruction and control information: determine whether there is a lighting device within a preset area of the second lighting device; if there is a lighting device within the preset area of the second lighting device, determine whether the lighting device within the preset area is in a turned-on state or not; and turn on the second lighting device if the lighting device within the preset area is in a turned-off state.

According to an embodiment of the present disclosure, if the lighting device within the preset area is in a turned-on state, the processor 510 is further configured to execute the computer program codes to, before transmitting the instruction and control information to the second lighting device: wait for the lighting device within the preset area to change from the turned-on state to the turned-off state.

According to an embodiment of the present disclosure, the processor 510 may be further configured to execute computer program code to modify identification information of the target parking location to identification information of occupancy, wherein the identification information of occupancy is used to indicate that the target parking location is in an unavailable state; and modify the identification information of the target parking location to identification information of being available when it is detected that the vehicle is moving away from the target area.

It will be appreciated by those skilled in the art that features described in embodiments and/or claims of the present disclosure may be combined and/or integrated variously, even if such combinations or integrations are not explicitly described in the present disclosure. Particularly, features described in embodiments and/or claims of the present disclosure may be combined and/or integrated variously without departing from the spirit and scope of the disclosure. All the combinations and/or integrations fall within the scope of the disclosure.

Further, an embodiment of the present disclosure further provides a parking navigation system, which may include a sensor and a lighting device in addition to the parking navigation device described in the above embodiments; wherein the sensor generates sensing information when a vehicle enters the sensing range of the sensor, and transmits the sensing information to the lighting device; and the lighting device is turned on in response to receiving indication and control information, and transmits prompt information to the parking navigation device when receiving the sensing information from the sensor.

For the foregoing method embodiments, for the sake of brevity, they are all described as a series of combinations of actions, but those skilled in the art should understand that the present disclosure is not limited by the described order of actions, because, according to the present disclosure, some steps can be performed in different orders or at the same time. In the following, those skilled in the art should also understand that embodiments described in the specification are all illustrative embodiments, and the actions and modules involved are not necessarily required by the present disclosure.

Various embodiments in the present specification are described in a progressive manner, and each embodiment focuses on differences from other embodiments, therefore the same or similar parts between various embodiments may be referred to each other.

Finally, it should also be noted that relational terms such as first and second are used herein merely to distinguish one entity or operation from another entity or operation, and do not necessarily require or imply that there is any such actual relationship or order between these entities or operations. Furthermore, terms "comprise," "contain" or any other variations thereof aim to cover a non-exclusive inclusion, so that the process, method, product or device including a series of elements includes not only these elements, but also other elements which are not explicitly listed, or it further includes elements inherent to such process, method, product or device. An element that is defined by the phrase "comprising a . . . " does not exclude the presence of additional elements in the process, method, product, or device that includes this element, unless there are other limitations.

A parking navigation method, a parking navigation device and a parking navigation system according to the present disclosure are described above in detail. The principles and implementations of the present disclosure are described herein by applying specific examples. However, the descriptions of the above embodiments are only used to facilitate the understanding of the method of the present disclosure and its core ideas. For those of ordinary skills in the art, there will be changes in specific embodiments and application scopes according to the ideas of the present disclosure. Therefore, the description should not be construed as limiting the disclosure.

I claim:

1. A parking navigation method, comprising:

acquiring initial location information of a vehicle;

acquiring a target planned path based on a preset rule according to the initial location information and target parking location information; and sequentially turning on lighting devices on the target planned path to guide the vehicle to travel to the target parking location, wherein the step of sequentially turning on the lighting devices on the target planned path comprises:

transmitting instruction and control information to a first lighting device closest to the vehicle on the target planned path to turn on the first lighting device, in response to receiving prompt information from the first lighting device, determining whether there is a lighting device within a preset area of a second lighting device closest to the first lighting device in a direction of travel of the vehicle;

if there is a lighting device within the preset area of the second lighting device, determining whether the lighting device within the preset area is in a turned-on state or not; and transmitting instruction and control information to the second lighting device to turn on the second lighting device it the lighting device within the preset area is in a turned-off state.

2. The method of claim 1, wherein the step of acquiring a target planned path based on a preset rule according to the initial location information and target parking location information comprises:

acquiring information about at least one target parking location in an available state in a target area;

acquiring at least one planned path according to the initial location information and the information about at least one target parking location; and selecting, according to a preset rule, one planned path from the at least one planned path as the target planned path.

3. The method of claim 2, wherein the preset rule includes that information on length of the selected planned path satisfies a first preset condition and/or information on vehicles on the selected planned path satisfies a second preset condition.

4. The method of claim 1, wherein if the lighting device within the preset area is in a turned-on state, the method further comprises, before transmitting to the second lighting device the instruction and control information:

waiting for the lighting device within the preset area to change from the turned-on state to the turned-off state.

5. The method of claim 2, wherein, after the step of acquiring a target planned path based on the preset rule, the method further comprises:

modifying identification information of the target parking location to identification information of being occupied, wherein the identification information of being occupied is used to indicate that the target parking location is in an unavailable state.

6. The method of claim 2, further comprising:

modifying the identification information of the target parking location to identification information of being available when it is detected that the vehicle is moving away from the target area.

7. The method of claim 1, wherein the number of the lighting devices is two or more, and on-duration of each of the lighting devices is 5 to 10 seconds.

8. A parking navigation device, comprising:

a memory in which computer program codes are stored;

a processor configured to execute the computer program codes stored in the memory to:

acquire initial location information of a vehicle;

acquire a target planned path based on a preset rule according to the initial location information and target parking location information; and transmit instruction and control information to lighting devices on the target planed path so as to sequentially turn on the lighting devices on the target planned path to guide the vehicle to travel to the target parking location, wherein the processor is further configured to execute the computer program codes to:

transmit instruction and control information to a first lighting device closest to the vehicle on the target planned path to turn on the first lighting device, in response to receiving prompt information from the first lighting device, determine whether there is a lighting device within a preset area of a second lighting device closest to the first lighting device in a direction of travel of the vehicle;

if there is a lighting device within the preset area of the second lighting device, determine whether the lighting device within the preset area is in a turned-on state or not; and transmit instruction and control information to the second lighting device to turn on the second lighting device if the lighting device within the preset area is in a turned-off state.

9. The parking navigation device of claim 8, wherein the processor is further configured to execute the computer program codes to:

acquire information about at least one target parking location in an available state in a target area;

acquire at least one planned path according to the initial location information and the information about at least one target parking location; and select, according to a preset rule, one planned path from the at least one planned path as the target planned path.

10. The parking navigation device of claim 9, wherein the preset rule includes that information on length of the selected planned path satisfies a first preset condition and/or information on vehicles on the selected planned path satisfies a second preset condition.

11. The parking navigation device of claim 8, wherein, if the lighting device within the preset area is in a turned-on state, the processor is further configured to execute the computer program codes to, before transmitting the instruction and control information to the second lighting device:

wait for the lighting device within the preset area to change from the turned-on state to the turned-off state.

12. The parking navigation device of claim 9, wherein the processor is further configured to execute the computer program codes to:

modify identification information of the target parking location to identification information of being occupied, wherein the identification information of being occupied is used to indicate that the target parking location is in an unavailable state; and modify the identification information of the target parking location to identification information of being available when it is detected that the vehicle is moving away from the target area.

13. The parking navigation device of claim 8, wherein the number of the lighting devices is two or more, and on-duration of each of the lighting devices is 5 to 10 seconds.

14. A parking navigation system, comprising:

a parking navigation device of claim 8;

a sensor configured to generate sensing information when a vehicle enters the sensing range of the sensor, and to transmit the sensing information to a lighting device; and the lighting device, configured to be turned on in response to receiving indication and control information, and to transmit prompt information to the parking navigation device when receiving the sensing information from the sensor.

* * * * *